US005819452A

United States Patent [19]

Hakkert

[11] Patent Number: 5,819,452

[45] Date of Patent: Oct. 13, 1998

[54] DISPLAY DEVICE

[76] Inventor: Roelof Martinus Hakkert, Geleenstraat 43'" , NL-1078 KD Amsterdam, Netherlands

[21] Appl. No.: 666,268

[22] PCT Filed: Dec. 30, 1994

[86] PCT No.: PCT/NL94/00328

§ 371 Date: Jun. 21, 1996

§ 102(e) Date: Jun. 21, 1996

[87] PCT Pub. No.: WO95/19026

PCT Pub. Date: Jul. 13, 1995

[30] Foreign Application Priority Data

| | | | |
|---|---|---|---|
| Jan. 3, 1994 | [NL] | Netherlands | 9400001 |
| Nov. 29, 1994 | [NL] | Netherlands | 9402004 |
| Nov. 29, 1994 | [NL] | Netherlands | 9402005 |

[51] Int. Cl.[6] ..... G09F 19/00

[52] U.S. Cl. ..... 40/406; 40/219; 40/427

[58] Field of Search ..... 40/406, 409, 564, 40/219, 900, 410, 427, 743; 446/267, 176

[56] References Cited

U.S. PATENT DOCUMENTS

| | | | |
|---|---|---|---|
| 1,887,285 | 11/1932 | Burrell et al. | 40/406 |
| 2,145,747 | 1/1939 | Askew | 40/406 |
| 3,101,564 | 8/1963 | Stoessel . | |
| 3,386,197 | 6/1968 | Elfstrom | 40/406 X |
| 3,964,194 | 6/1976 | Gugeler | 40/406 |
| 4,144,663 | 3/1979 | Saenger et al. | 40/406 |
| 5,106,660 | 4/1992 | Vorel | 40/406 X |

FOREIGN PATENT DOCUMENTS

| | | |
|---|---|---|
| 0 221 018 | 5/1987 | European Pat. Off. . |
| 26 13 024 | 9/1977 | Germany . |
| 88 09 904.0 | 3/1989 | Germany . |

*Primary Examiner*—Brian K. Green
*Attorney, Agent, or Firm*—Young & Thompson

[57] ABSTRACT

A display device with a light source and an effervescent effect generator. The effervescent effect generator has a housing with a light transmissive portion that is filled with a liquid and a gas and is sealed closed. A pump and hose form bubbles of the gas that is sealed in the housing in the liquid in the housing so that the liquid appears to be effervescent when viewed at the light transmissive portion.

18 Claims, 5 Drawing Sheets

24
20
26
25
27
23
4
22
16

DISPLAY DEVICE

BACKGROUND OF THE INVENTION

The present invention relates to a display device at least provided with a light source and image-carrying means which comprises an effervescent effect generator, which is provided with a housing of at least partially light-transmitting material. The housing is filled, during use, with a liquid and a gas. The effervescent effect generator also comprising pumping means and hose-like means to be connected thereto for pumping round the liquid and/or the gas and generating gas bubbles.

Such a display device is known from U.S. Pat. No. 3,101,564. The known display device comprises a light source and a tank of transparent material filled with a liquid. In the tank a conduit provided with apertures is positioned, which is connected to a source of gas under pressure located outside the tank. At the top portion thereof the tank is provided with a relief aperture to permit the gas passing through the liquid in the form of bubbles to escape from the top of the tank. The light source is positioned such that the light beams are in the plane of movement of the stream of bubbles.

SUMMARY OF THE INVENTION

The device according to the invention is characterized in that the housing is a sealed closed housing. An effervescent effect generator of this type has the important advantage that said generator requires little maintenance and, therefore, in addition to low production costs also has low maintenance costs.

In a further embodiment of the present invention, the liquid comprises demineralized water, by which means it is possible, in a simple manner, to prevent turbidity in the effervescent effect generator as a result of, inter alia, the growth of algae.

A display device is for instance disclosed in Netherlands Patent Application 89010125. In this publication a screen is described which can be irradiated on one side by a light source, symbols being displayed on the other side. To this end the screen comprises a sheet of opalescent plastic material provided with a light-excluding layer, in which openings are made which correspond with the symbols to be displayed.

The known display device has the disadvantage that the dimensions thereof are large, particularly in respect of the thickness thereof. This is mainly due to the distance which is maintained in the known display device between the light source and the image-carrying means in order to eliminate the so-called adverse "washboard effect", which arises when such light sources are placed too close to the image-carrying means. In practice, the known display device is therefore installed in a wall in order to save space, which appreciably increases the installation costs.

In order to overcome the abovementioned disadvantage in one embodiment of the display device according to the invention reflecting sheet means are arranged essentially behind the light source and parallel to the image-carrying means.

Furthermore, the display device has the advantage that, as a result of the use of reflecting sheet means, the light source has a greater effective light output, as a result of which a standard light source, for example a fluorescent tube, can be used, with which an outstanding light effect can be obtained, both in a light room and in a dark room. There is therefore no need to make use of expensive UV tubes (so-called "black lights") in order to obtain special light effects. Because of the bright display, the display device according to the invention attracts the attention of passers-by and is therefore extremely suitable for advertising purposes.

A display device at least provided with a light source and image-carrying means, wherein reflecting sheet means are arranged essentially behind the light source and parallel to the image-carrying means is known per se from DE-8809904.

In a further embodiment, reflecting sheet means are arranged essentially adjacent the light source and transversely to the image-carrying means. In this embodiment the light output is further increased in a simple and advantageous manner and the light is better distributed, as a result of which the abovementioned effects are intensified.

In an advantageous embodiment, the reflecting sheet means comprise a sheet of plastic material, for example based on acrylate. The display device according to this embodiment displays the image very brightly as a result of the surprising effect of the combination of the plastic sheet material and artificial light.

In a further advantageous embodiment, the light source comprises one or more fluorescent tubes, chokes associated with the one or more fluorescent tubes being placed outside the plane of the reflecting sheet means. This embodiment advantageously eliminates the adverse shadow effects which can be caused by said chokes.

In a subsequent embodiment, the display device is provided with a frame in which the one or more fluorescent tubes are detachably placed in various positions. This embodiment makes it possible, in a simple manner, to achieve various light effects by varying the number of fluorescent tubes and the positions thereof.

In another embodiment, the image-carrying means comprise a first mirror, which on one side has a light-excluding layer provided with openings essentially corresponding to the image to be displayed. A display device according to this embodiment can be constructed quickly, simply and at low cost.

In yet a further embodiment, the image-carrying means comprise a second, at least partially light-transmitting mirror, which is placed in front of the first mirror. This embodiment advantageously displays the image at least partially repeated, as a result of which a depth effect is obtained.

According to another advantageous embodiment of the present invention, the image-carrying means comprise fluorescent material. This embodiment of the display device displays the image in a quality comparable to that produced by a likewise known display device provided with a neon light source, but has appreciably lower production costs. In addition, this embodiment has the advantage that the colors are retained well, even on exposure to sunlight.

In a further embodiment, the image-carrying means comprise at least one slide. Even complex images can be displayed brightly and clearly in a relatively inexpensive manner with the aid thereof.

As a result of the addition of said effervescent effect generator a flow of bubbles in the image can be displayed in a simple, reliable manner and at low cost. As a result of the combination of the bright display of the image, described above, and said flow of bubbles, the attention of passers-by is drawn even more strongly to the display device, as a result of which the usability thereof for transmitting advertising messages is further increased.

The invention also relates to an effervescent effect generator, as described above.

BRIEF DESCRIPTION OF THE DRAWINGS

The invention will be further explained with reference to the appended drawings, wherein.

DESCRIPTION OF THE PREFERRED EMBODIMENT

Figure 1:
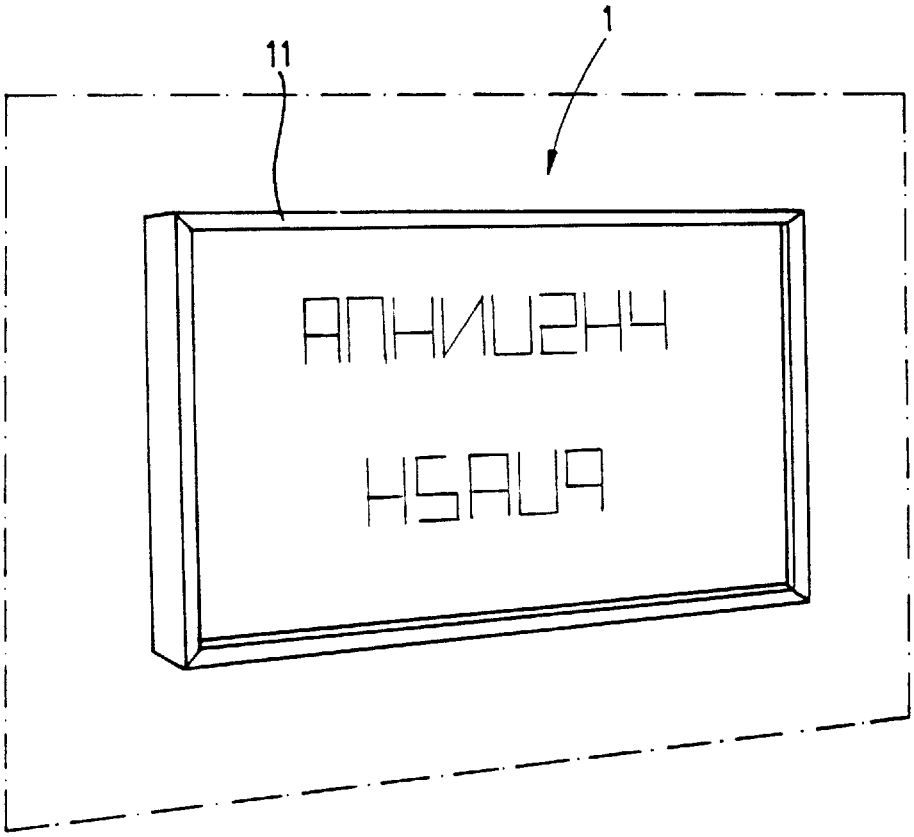
FIG. 1 shows a front view of a first embodiment of a display device according to the invention.

FIG. 1 shows a first embodiment of a display device according to the present invention. In this first embodiment, the display device according to the invention is preferably constructed in the shape of a painting and is suitable for fixing to a wall, as shown in FIG. 1.

Figure 2:
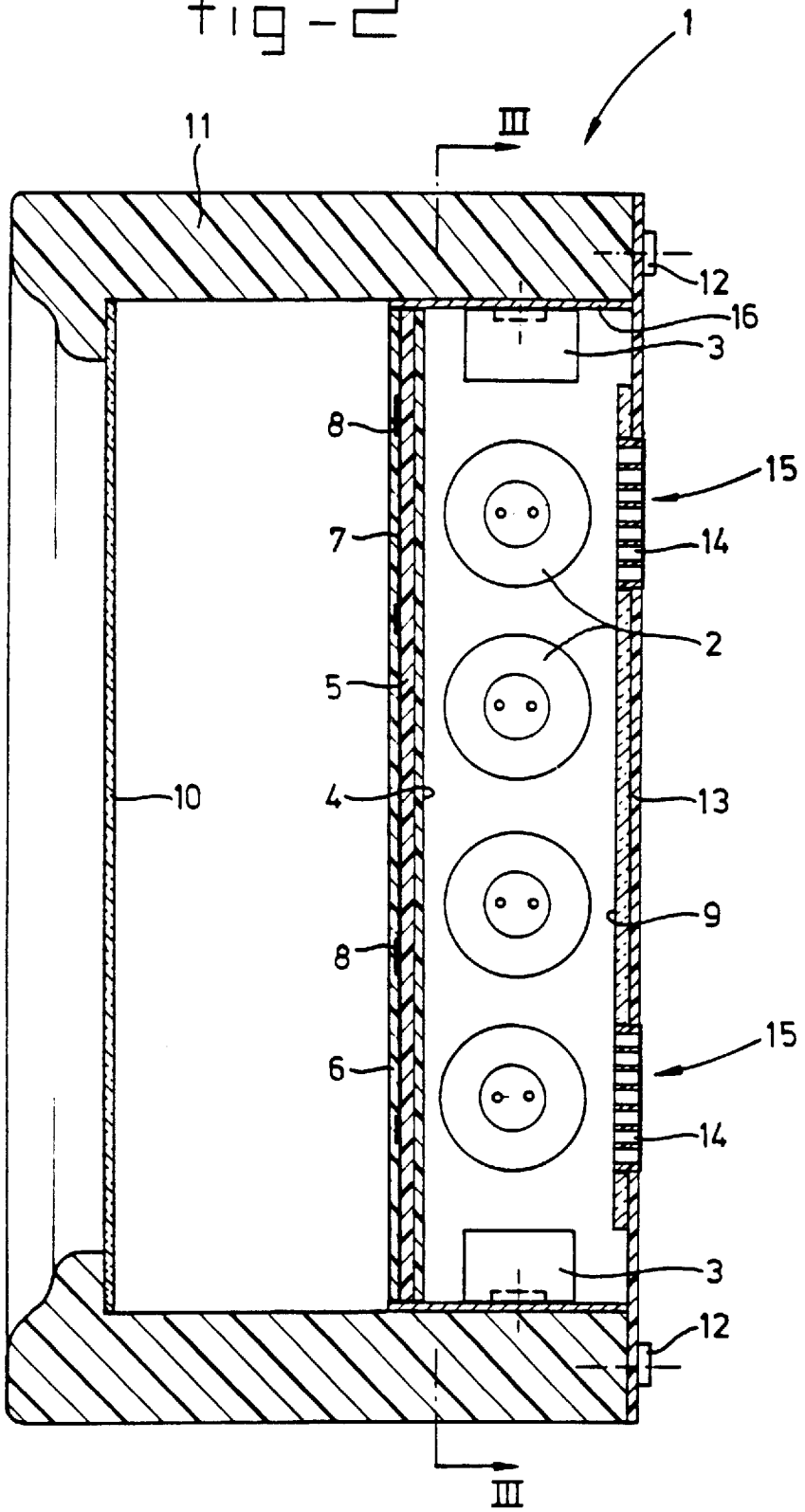
FIG. 2 shows a cross-sectional view of the display device from FIG. 1.

FIG. 2 shows a cross-sectional view of display device 1 from FIG. 1. In this first embodiment the light source is made up of four fluorescent tubes 2. The associated chokes 3 are mounted completely separately from the fluorescent tubes 2 in order to prevent shadow effects which would otherwise arise in the image. In this embodiment, the image-carrying means comprise light-transmitting plastic sheet means 4, preferably based on acrylate and optionally in transparent or translucent fluorescent colors, on which, if desired, fluorescent material 5 can be arranged which can comprise differently colored sections corresponding to the intended colour effects in the image. Suitable fluorescent materials are, for example, fluorescent paste, fluorescent film, perspex granules or a fluorescent perspex sheet. In this connection, plastic material based on acrylate (perspex) has the advantage that the color quality is retained, even on exposure to sunlight. The image-carrying means further comprise a first mirror 6, which is provided on the back with a light-excluding layer 7. Openings 8 are made in the light-excluding layer 7, which openings essentially correspond to the image to be displayed. The openings 8 can, for example, be made by sand-blasting the mirror. By then providing the sand-blasted parts with a coating of clear lacquer, preferably a water-based lacquer, the light from the light source 2 is able to pass through unhindered. In order to obtain a high and uniformly distributed light output, reflecting sheet means 9 are arranged behind the fluorescent tubes 2. By this means, the radiation, which originally was directed backwards, is reflected to the plastic sheet material 4, as a result of which the light output is appreciably increased. In order further to increase and to distribute the light output, further reflecting sheet means (not shown) can be arranged adjacent the fluorescent tubes and transversely to the image-carrying means. The reflecting sheet means can comprise, for example, a plastic sheet material, preferably based on acrylate, or mirror glass. In order to increase the light effect, a second, at least partially light-transmitting mirror 10 can optionally be placed in front of the first mirror 6. By this means a repeated display of the image is obtained, as a result of which a depth effect is introduced into the display device. With this arrangement, the number of times the image is repeated is also dependent on the degree of fluorescence of the materials used. With the aid of the abovementioned fluorescent materials, the image can, for example, be displayed repeated 15 to 20 times in the illustrative embodiment shown. The spacing between the repeated images is determined by the distance between the first mirror 6 and the second mirror 10. Preferably, this distance is so chosen that the repeated images are clearly distinguishable from one another. If a distance shorter than this preferred distance is chosen, the space between the repeated images decreases, with the result that these can start to overlap, in contrast, if a greater distance is chosen, the space between the repeated images increases. In this latter case there is room to optionally place an object between mirror 6 and mirror 10, with the result that this object is also repeatedly displayed. If, by way of example, the distance is about 7 cm, the display device can be provided with a virtual depth of about 2 meters if suitable materials are chosen. Furthermore, parts of the image which are not to be repeated can be covered as desired, for example by applying black film, provided with cut-outs corresponding to said parts, to the front of the first mirror 6.

Display device 1 is provided with frame 11, which preferably is made of molded plastic. Materials such as wood, metal or mirror glass are, however, also suitable. The second mirror 10 can optionally be produced as a detachable module which is provided with its own frame, with which the module can be detachably fixed to frame 11 (which is then made appreciably shorter). Display device 1 has a thickness of about 5 cm exclusive of mirror 10, or about 12 cm inclusive of mirror 10. It must be pointed out that in FIG. 2 the thickness of the display device is essentially to scale, but the length is not, which is apparent by comparison with FIG. 1.

Spacers 12 are provided for fixing the display device 1 to a wall, to provide cooling for the electrical apparatus contained in the display device. For cooling purposes, air holes 14 and grilles 15 are made in the reflecting plate means 9 and in the back plate 13. If the display device 1 is positioned vertically, as shown in FIG. 2, cooling will take place by means of natural air flow.

Figure 3:
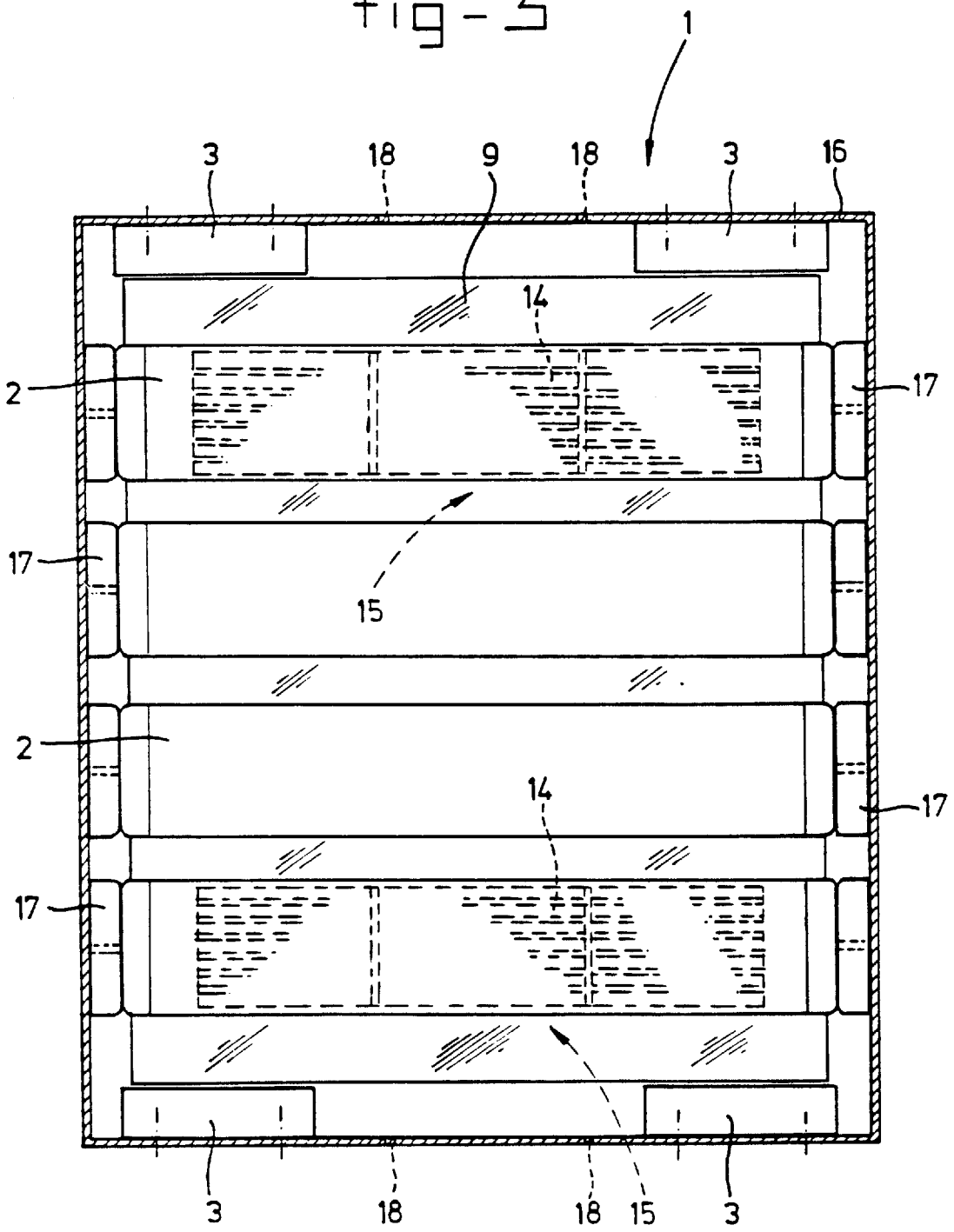
FIG. 3 shows a longitudinal sectional view of a cross-section of the display device in FIG. 2 along the line III—III.

FIG. 3 shows a front view of a cross-section of the display device shown in FIG. 2 along the line III—III. Frame 16 is shown, in which frame one or more fluorescent tubes 2 can be placed detachably in various positions (in this example there are four fluorescent tubes each of 18 watt). The frame 16 is provided with universal lamp fittings 17, in which all types of fluorescent tubes can be mounted. The chokes 3 can also be fixed to the frame 16. In this example, the frame 16 is composed of 4 mm thick iron strip in which mounting holes 18 have been made, by means of which the frame 11 can be fixed to the frame 16.

Figure 4:
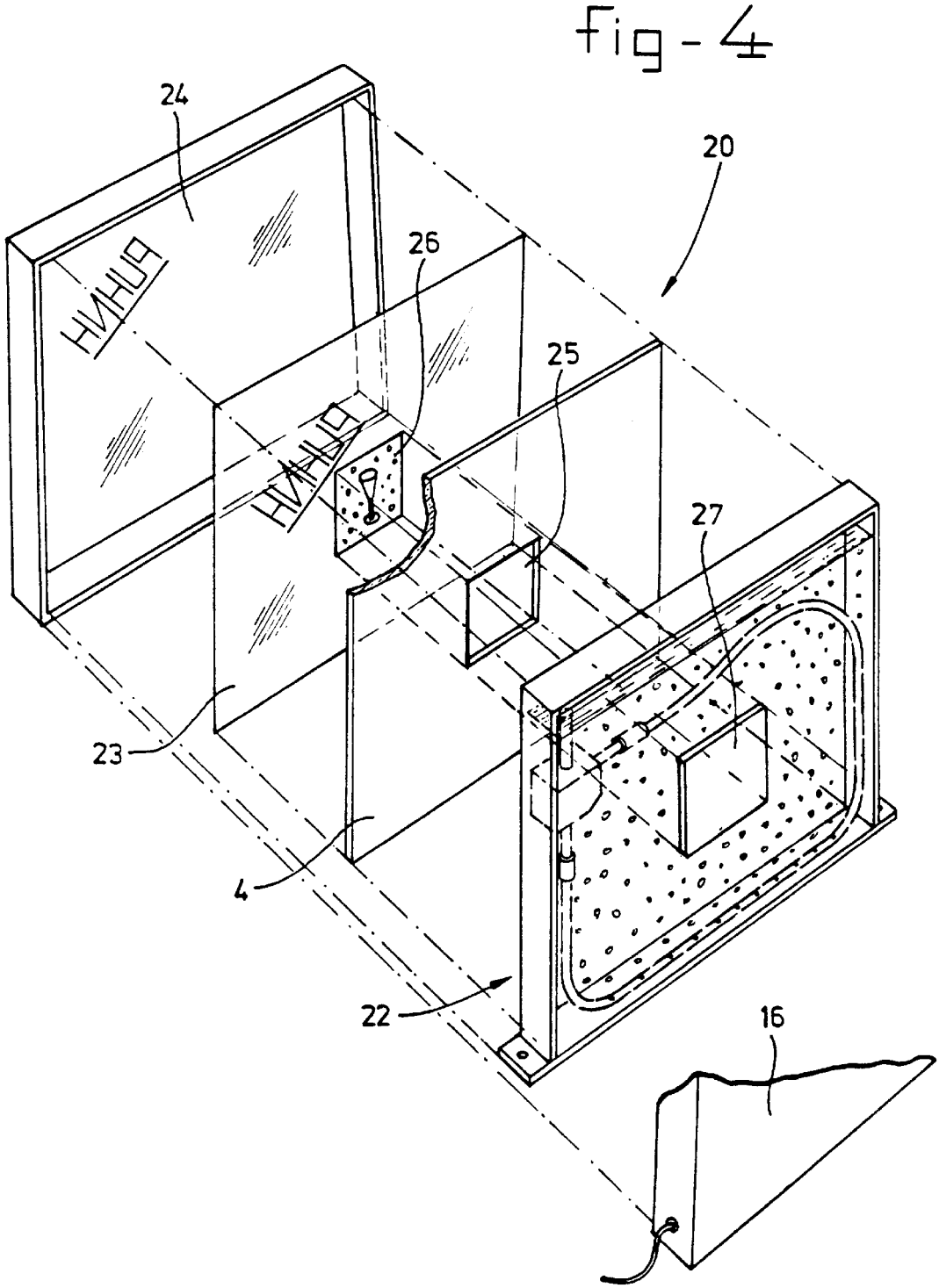
FIG. 4 shows an exploded view of a second embodiment of the display device according to the present invention.

FIG. 4 shows an exploded view of a second embodiment 20 of the display device according to the present invention. The second embodiment 20 shown comprises a frame 16, as shown in FIG. 3, which likewise is provided with the said reflecting means. The image-carrying means comprise plastic sheet material 4, just as in the first embodiment, and also an effervescent effect generator 22, a slide plate 23 and protective means 24. The effervescent effect generator 22 can, for example, be used to simulate, in a technically simple manner, the behaviour of carbonated drinks, to be displayed with the aid of the image-carrying means. The slide plate 23 can replace both the fluorescent material 5 and the sand-blasted mirror 6 and the partially light-transmitting mirror 10 from the first illustrative embodiment shown in FIG. 2. All sorts of arbitrary objects can thus be displayed in more detail in a simple manner with the aid of slide plate 23. Preferably, the material of slide plate 23 is so chosen that the color quality is retained, even on exposure to sunlight.

Protective means 24 can be arranged in front of the image-carrying means in order to protect the display device 1 and, more particularly, to protect the slide plate 23. They can be composed, for example, of matt glass, non-reflecting plastic based on acrylate, or mirror glass. To render the effervescent effect of the effervescent effect generator visible on the front of the display device, it is possible, for example, to make an opening 25 in the plastic sheet material 4 in a position which corresponds with position 26 in the slide plate 23 at the point where the effervescent effect must be visible. Reflecting sheet means 27 can optionally be fitted on effervescent effect generator 22, as a consequence of which the said effervescent effect will be visible twice at the front of the display device 1.

Figure 5:
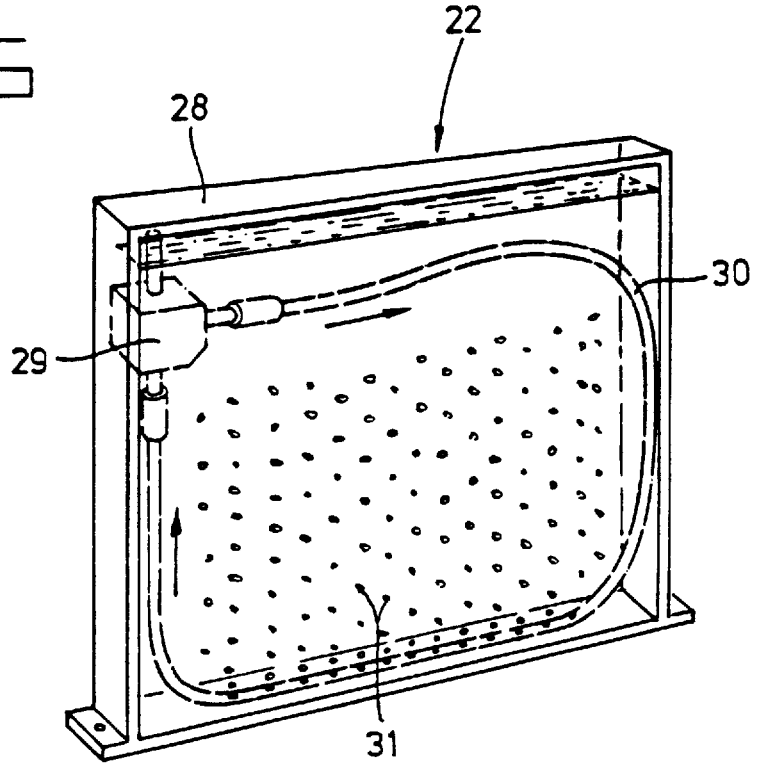
FIG. 5 shows a first embodiment of an effervescent effect generator suitable for use in a display device according to the present invention.

FIG. 5 shows a first embodiment of the effervescent effect generator 22 which is suitable for use in a display device according to the present invention. The effervescent effect generator shown is composed of a sealably closable housing 28 capable of withstanding water pressure and is composed of at least partially light-transmitting material, for example plastic material, preferably based on acrylate. In use, the housing 28 is filled with a liquid and a gas, which can be pumped round with the aid of the provided pumping means 29 and hose-like means 30 in the housing 28 with the formation of gas bubbles 31. The effervescent effect generator 22 can be of either open (not shown) or closed construction. In the open embodiment, the housing 28 comprises closable regulating nuts (not shown), which are opened during use. This open system has the disadvantage that the liquid will evaporate and have to be replenished after a certain time. Therefore preferably a closed system is used for the effervescent effect generator 22, since this system requires much less maintenance. With the aid of underwater pumping means 29, which are known per se, the gas and/or the liquid can be pumped round via the hose means 30, the hose means 30 in FIG. 5 being of porous construction so that the gas can escape therefrom with the formation of bubbles 31 which move upwards through housing 28, as shown in FIG. 5.

Figure 6:
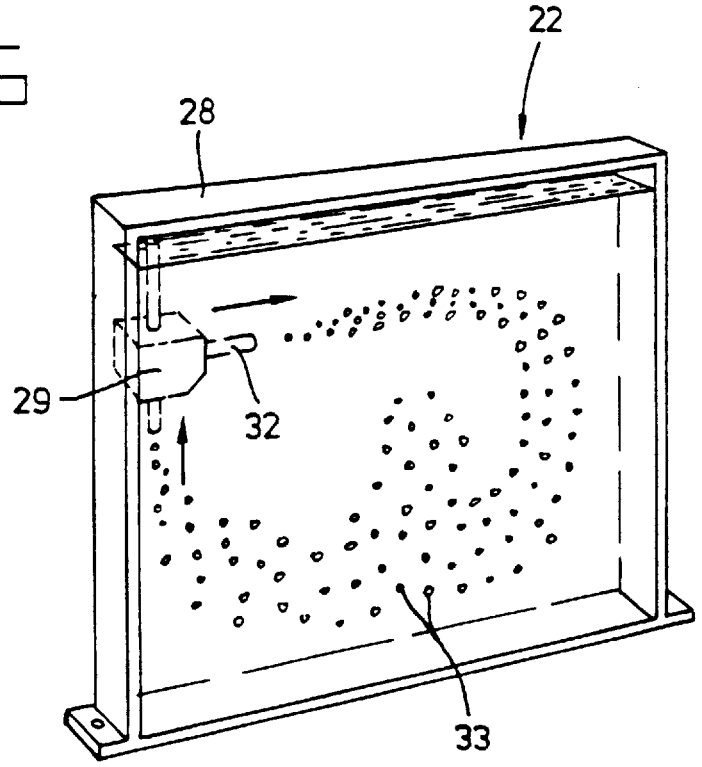
FIG. 6 shows a second embodiment of an effervescent effect generator suitable for use in a display device according to the present invention.

A second embodiment of effervescent effect generator 22 is shown in FIG. 6. This differs from the first embodiment shown in FIG. 5 in respect of the hose-like means 32, which are appreciably shorter in this second embodiment, as a result of which the gas and/or the liquid can be driven out more forcefully, with the result that a whirl effect is obtained. Various water effects can be combined as desired.

Preferably the effervescent effect generator 22 is filled with demineralized water to prevent the growth of algae. In the simplest embodiment, the said gas is air. However, it will be clear that various combinations of existing liquids and/or gases (colorless or colored) can be used in order to produce different effects. If desired, light-transmitting and/or light-reflecting materials can be added to the liquid. In addition, housing 28 can be made of colored and/or fluorescent material and/or various types of coloured and/or fluorescent material can be fitted thereon, as desired.

It will be abundantly clear to a person skilled in the art that the invention is not restricted to the embodiments shown, but extends to any arbitrary combination of the abovementioned image-carrying means, on their own or in combination with an effervescent effect generator. To this end, the display device according to the invention can be of modular construction. In addition to the abovementioned module containing the partially light-transmitting mirror, it is also possible, for example, to construct the effervescent effect generator as a module which can be detachably mounted. In particular, the effervescent effect generator 22 can also be used in combination with the image-carrying means described for the first illustrative embodiment (see FIG. 2). For example, the protective means 24, as shown in FIG. 4, can be replaced by the sand-blasted mirror 6 and/or the at least partially light-transmitting mirror 10 shown in FIG. 2. Furthermore, it will be clear that many known means are suitable to serve as image-carrying means for use in the display device according to the present invention.

I claim:

1. A display device comprising:

an effervescent effect generator having a housing with a light transmissive portion, said housing being filled with a liquid and a gas and sealed closed, said generator further having pump means for forming bubbles of the gas that is sealed in said housing, said pump means being enclosed in said sealed closed housing in contact with the liquid, the bubbles being formed in the liquid in said housing so that the liquid appears to be effervescent when viewed at said light transmissive portion; and a light source for providing light to said light transmissive portion.

2. The display of claim 1, wherein said pump means comprise a pump and a hose attached to said pump, said hose being in a bottom portion of said housing and having a multiplicity of openings for forming the bubbles of the gas.

3. The display of claim 1, wherein said pump means comprise a pump for forming the bubbles and for pumping the liquid in said sealed closed housing and a hose attached to said pump, said hose having an end open to the liquid for ejecting the pumped liquid and the bubbles.

4. The display of claim 1, further comprising a first mirror adjacent said light source, said first mirror having a light excluding layer on a first side facing said light source, said light excluding layer having openings corresponding to an image to be displayed.

5. The display of claim 4, wherein said light transmissive portion is visible through said openings.

6. The display of claim 4, further comprising a second mirror that is at least partially light transmissive, and this is facing a second side of said first mirror opposite said first side.

7. The display of claim 1, wherein said pump means comprise a pump that is at least partially submerged within the liquid in said housing.

8. The display of claim 1, wherein said light transmissive portion comprises plastic.

9. The display of claim 1, further comprising light reflecting means adjacent said light source and arranged to reflect light from said light source to said light transmissive portion.

10. The display of claim 1, wherein said light source comprises at least one fluorescent tube.

11. The display of claim 1, further comprising a colored fluorescent material through which said light transmissive portion is visible.

12. The display of claim 1, further comprising a slide bearing images through which said light transmissive portion is visible.

13. An effervescent effect generator comprising:

a housing with a light transmissive portion, said housing being filled with a liquid and a gas and sealed closed; and a pump and a hose attached to said pump for forming bubbles of the gas that is sealed in said housing, said pump and said hose being enclosed in said sealed closed housing in contact with the liquid, the bubbles being formed in the liquid in said sealed closed housing so that the liquid appears to be effervescent when viewed at said light transmissive portion.

14. The generator of claim 13, wherein said housing is planar and wherein said light transmissive portion comprises opposing sides of said housing that are transparent.

15. The generator of claim 13, wherein said hose is in a bottom portion of said housing and has a multiplicity of openings for forming the bubbles of the gas.

16. The generator of claim 13, wherein said pump is for forming the bubbles and for pumping the liquid in said sealed closed housing, and wherein said hose has an end open to the liquid for ejecting the pumped liquid and the bubbles.

17. The generator of claim 13, wherein the liquid comprises demineralized water.

18. A display device comprising:

a bubble generator having a housing with a light transmissive portion, said housing being filled with a liquid and a gas and sealed closed, said generator further having pump means for forming bubbles of the gas that is sealed in said housing, the bubbles being formed in the liquid in said sealed closed housing;

a light source for providing light to said light transmissive portion; and a first mirror adjacent said light source, said first mirror having a light excluding layer on a side facing said light source, said light excluding layer having openings corresponding to an image to be displayed.

* * * * *